US010947971B2

(12) United States Patent
Nonaka et al.

(10) Patent No.: US 10,947,971 B2
(45) Date of Patent: Mar. 16, 2021

(54) VARIABLE DISPLACEMENT VANE PUMP

(71) Applicant: HITACHI AUTOMOTIVE SYSTEMS, LTD., Hitachinaka (JP)

(72) Inventors: Satoshi Nonaka, Sagamihara (JP); Jun Soeda, Fujisawa (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 275 days.

(21) Appl. No.: 16/082,245

(22) PCT Filed: Feb. 15, 2017

(86) PCT No.: PCT/JP2017/005530
§ 371 (c)(1),
(2) Date: Sep. 4, 2018

(87) PCT Pub. No.: WO2017/154490
PCT Pub. Date: Sep. 14, 2017

(65) Prior Publication Data

US 2020/0291938 A1 Sep. 17, 2020

(30) Foreign Application Priority Data

Mar. 7, 2016 (JP) ..... JP2016-043541

(51) Int. Cl.
*F04C 2/344* (2006.01)
*F04C 15/06* (2006.01)
*F04C 14/22* (2006.01)

(52) U.S. Cl.
CPC ..... *F04C 2/344* (2013.01); *F04C 14/226* (2013.01); *F04C 15/06* (2013.01)

(58) Field of Classification Search
CPC ..... F04C 2/344; F04C 14/226; F04C 15/06; F04C 15/00
See application file for complete search history.

(56) References Cited

U.S. PATENT DOCUMENTS 6,352,415 B1 * 3/2002 Uchino ..... B62D 5/062 417/220
9,879,670 B2 * 1/2018 Akatsuka ..... F04C 14/223

FOREIGN PATENT DOCUMENTS

| | | | |
|---|---|---|---|
| JP | H06-067881 | U | 9/1994 |
| JP | 2002-098067 | A | 4/2002 |
| JP | 2003-120551 | A | 4/2003 |
| JP | 2010-216371 | A | 9/2010 |

OTHER PUBLICATIONS

Office Action issued in corresponding Japanese Patent Application No. 2016-043541 dated Oct. 8, 2019 with English translation.

* cited by examiner

*Primary Examiner* — Charles G Freay
(74) *Attorney, Agent, or Firm* — Foley & Lardner LLP

(57) ABSTRACT

Provided is a variable displacement vane pump which is capable of reducing fluctuation in discharge rate. In the variable displacement vane pump, a first straightening vane 33 closest to one end-side opening 14*a* of a discharge passage 14 among a plurality of straightening vanes 33, 34 and 35 arranged within the discharge pressure chamber 202 is located so as not to face a communication hole 32 of a pressure plate 2*c*.

10 Claims, 6 Drawing Sheets

VARIABLE DISPLACEMENT VANE PUMP

TECHNICAL FIELD

The invention relates to variable displacement vane pumps.

BACKGROUND ART

The pumps of this type include variable displacement vane pumps with vanes that are allowed to move into and out of the slits of a rotor. The pump varies the volumes of pumping chambers defined by the inner peripheral surface of a cam ring, the outer peripheral surface of the rotor, and the vanes. The hydraulic fluid pressurized in the pumping chambers is delivered into a high-pressure chamber through communication holes of a pressure plate. The hydraulic fluid is then supplied to a hydraulic device through a discharge passage communicating with the high-pressure chamber. Patent Literature 1 discusses an example of the foregoing variable displacement vane pumps.

CITATION LIST

Patent Literature

PTL 1: Japanese Unexamined Patent Application Publication (Kokai) No. 2010-216371

SUMMARY OF INVENTION

Technical Problem

In the related art, there is a need for reduction of fluctuation in discharge rate.

It is an object of the invention to provide a variable displacement vane pump which is capable of reducing fluctuation in discharge rate.

Solution to Problem

A variable displacement vane pump according to one embodiment of the invention is so configured that a first rib closest to one end-side opening of a discharge passage among ribs disposed within a high-pressure chamber is situated so as not to face a communication hole of a pressure plate.

The variable displacement vane pump according to the one embodiment of the invention is capable of reducing the fluctuation in discharge rate.

DESCRIPTION OF EMBODIMENTS

Embodiment 1

Figure 1:
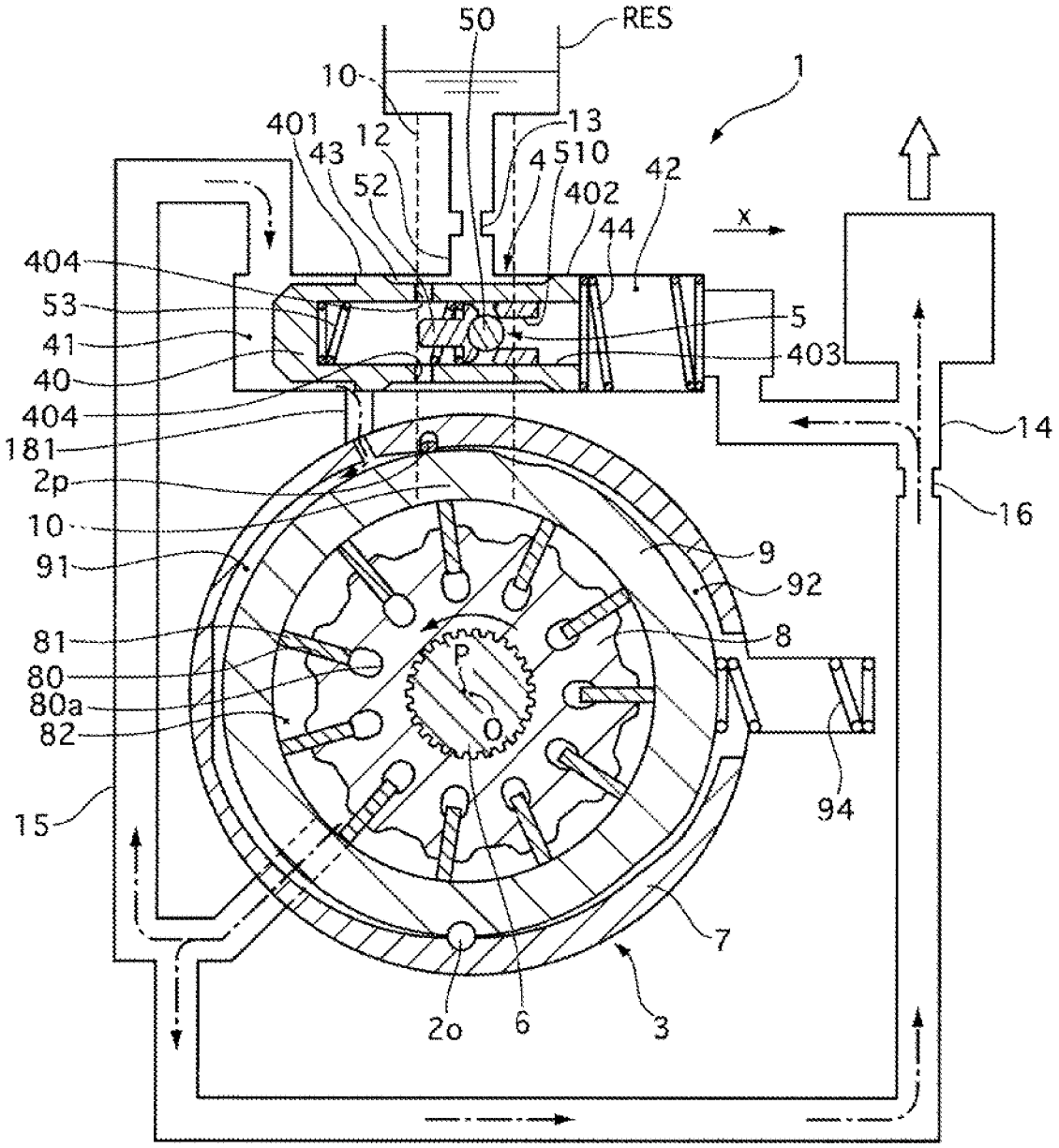
FIG. 1 is a schematic view of a pump 1 and passages (fluid paths) through which hydraulic fluid passes according to an Embodiment 1.
Figure 2:
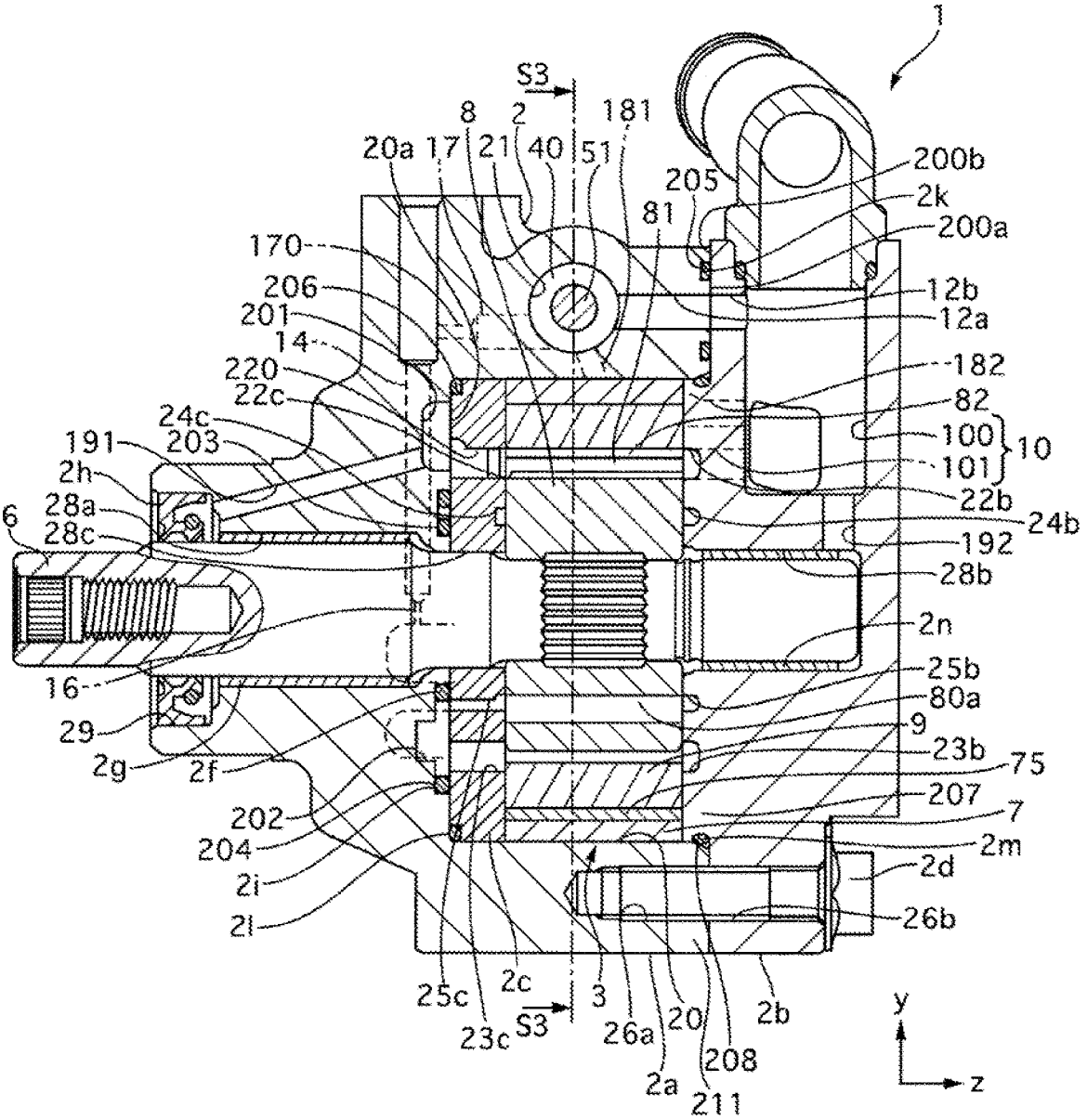
FIG. 2 is an axial cross-section of the pump 1 according to the Embodiment 1.
Figure 3:
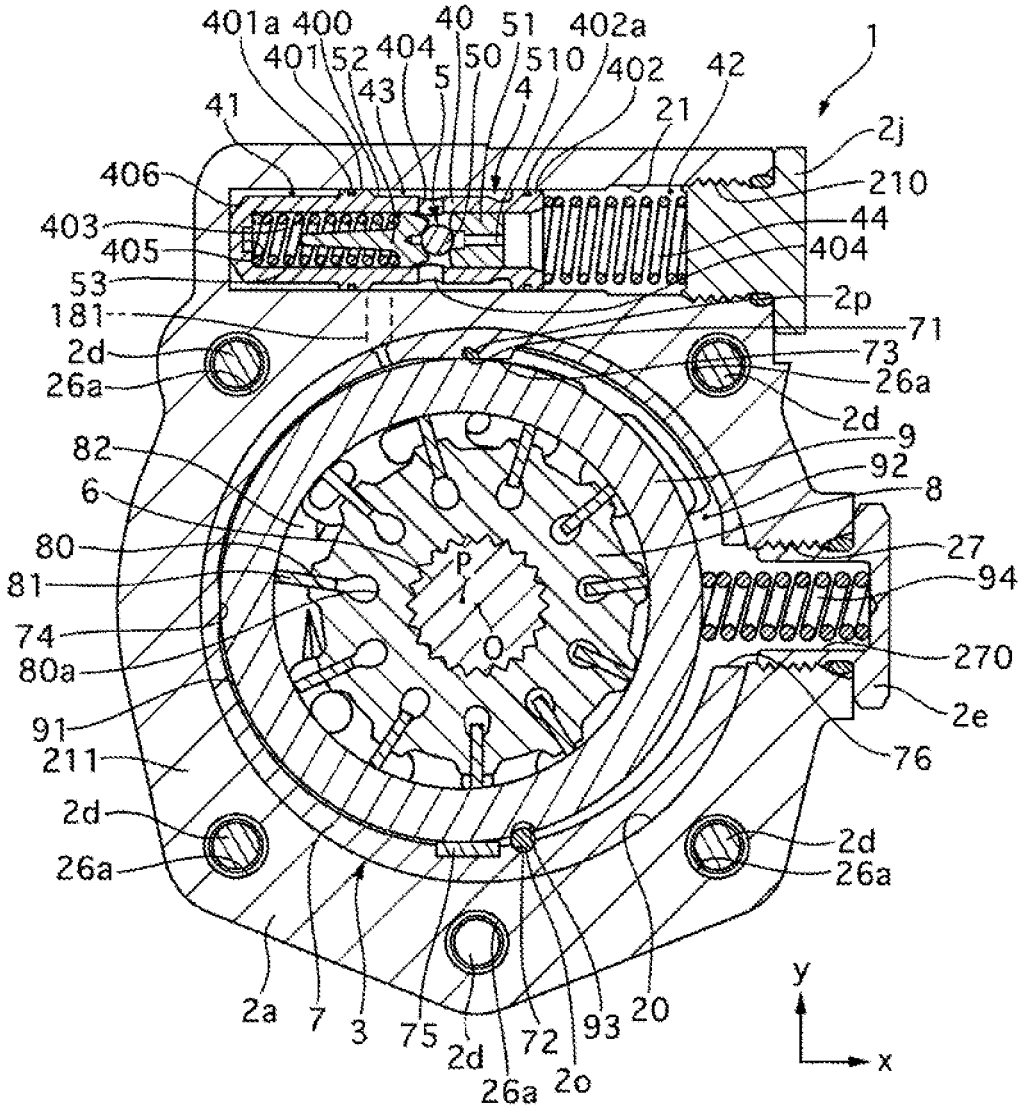
FIG. 3 is a cross-section along line S3-S3 of FIG. 2.
Figure 4:
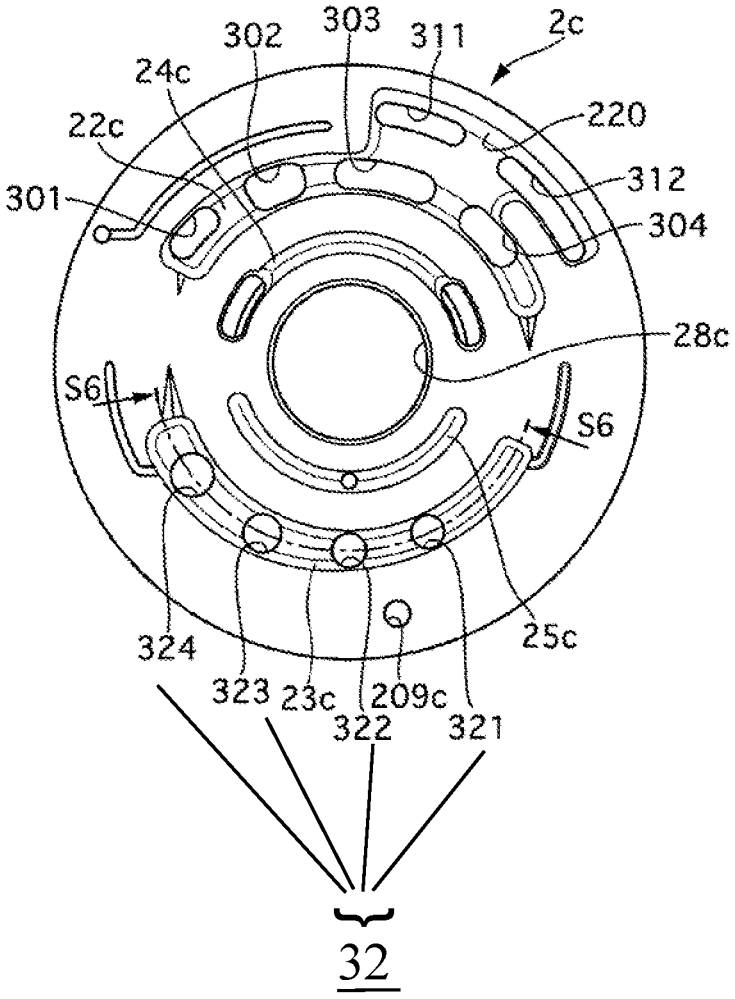
FIG. 4 is an elevation view of a pressure plate 2*c* according to the Embodiment 1.
Figure 5:
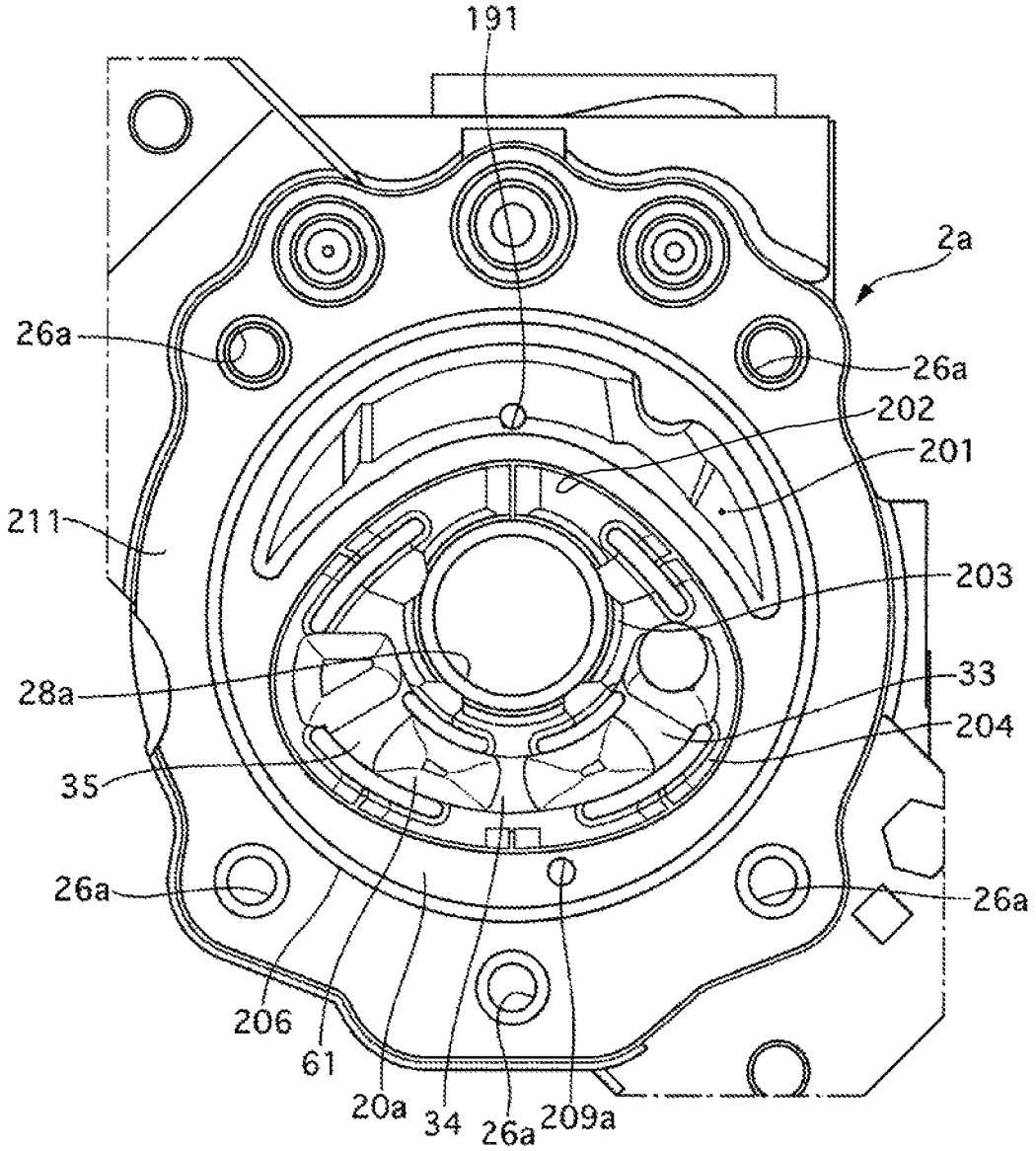
FIG. 5 is an elevation view of a front body 2*a* according to the Embodiment 1.

A variable displacement vane pump (hereinafter, referred to as a pump 1) according to the present embodiment is a pump unit applied to a hydraulic power steering system for a vehicle. The variable displacement vane pump functions as a hydraulic fluid source for supplying hydraulic fluid to the power steering system. The power steering system includes a power cylinder disposed in a steering gearbox. The pump 1 is driven by an internal combustion engine functioning as a motor to suck the hydraulic fluid from a reservoir tank RES and discharge the hydraulic fluid to the power cylinder. FIG. 1 is a schematic view of the pump 1 and passages (fluid paths) through which the hydraulic fluid passes. FIG. 2 is an axial cross-section of the pump 1. FIG. 3 is a cross-section along line S3-S3 of FIG. 2. FIG. 4 is an elevation view of a pressure plate 2*c*. FIG. 5 is an elevation view of a front body 2*a*. Hereinafter, a z-axis represents a direction in which a rotational axis 0 extends. X- and y-axes respectively represent major and minor axis directions of a substantially elliptical inner peripheral surface of an adapter ring 7 within a plane orthogonal to the z-axis.

The pump 1 includes a pump housing 2, a pump element 3, and a control valve 4. The pump housing 2 is a housing which accommodates the pump element 3 and the control valve 4. The pump housing 2 is made of, for example, an aluminum metal material. The pump housing 2 is provided with a pump element housing portion and a valve housing portion, which function as housing spaces, an inlet port 22 in communication with the reservoir tank RES, and an outlet port 23 in communication with the power cylinder. A drive shaft 6 is rotatably supported in the pump housing 2. The drive shaft 6 is driven by a crankshaft of the internal combustion engine. The pump element 3 is accommodated in the pump element housing portion and rotationally driven by the drive shaft 6, to thereby perform pumping work. The pump element 3 sucks the hydraulic fluid from the inlet port 22 and discharges the hydraulic fluid to the outlet port 23. The pump element 3 is of a variable displacement type which variably controls an amount of the hydraulic fluid discharged by the pump element 3 per rotation of the drive shaft 6 (hereinafter, referred to as a pump capacity). The control valve 4 is housed in the valve housing portion. The control valve 4 switches, in accordance with an operating condition of the pump element 3, a hydraulic-fluid supply state in which the hydraulic fluid is supplied from the pump element 3 to a fluid pressure chamber 91, to thereby control the pump capacity.

The pump housing 2 is provided with fluid passages including a suction passage 10, a drain passage 12, a discharge passage 14, a high pressure passage 15, a control pressure passage 17, first and second fluid pressure passages 181 and 182, and first and second bearing lubrication passages 191 and 192. The suction passage 10 connects the reservoir tank RES and the inlet port 22 to each other. The suction passage 10 leads to the inlet port 22 and forms a suction area together with the inlet port 22. The drain passage 12 connects the control valve 4 and the suction passage 10 to each other. In other words, the drain passage 12 is interposed between the control valve 4 and the suction area. The discharge passage 14 connects the outlet port 23 and the steering gearbox (power cylinder) to each other. The discharge passage 14 leads to the outlet port 23. A metering orifice 16 is disposed in the discharge passage 14. The metering orifice 16 is a contracted portion formed in the discharge passage 14. A relief valve 5 is housed in the valve housing portion. When pressure existing on the discharge passage 14 side exceeds predetermined pressure, the relief valve 5 discharges the hydraulic fluid existing on the discharge passage 14 side to the suction area side. The high pressure passage 15 diverges from the discharge passage 14 at a point located on the outlet port 23 side of the metering orifice 16 in the discharge passage 14 (hereinafter, referred to as an upstream side) and connects the upstream side of the discharge passage 14 and the control valve 4 to each other. The control pressure passage 17 diverges from the discharge passage 14 at a point located on the power cylinder side of the metering orifice 16 in the discharge passage 14 (hereinafter, referred to as a downstream side) and connects the downstream side of the discharge passage 14 and the control valve 4 to each other. A pilot orifice 170 is disposed in the control pressure passage 17. The pilot orifice 170 is a contracted portion formed in the control pressure passage 17. The first fluid pressure passage 181 connects the control valve 4 and the pump element 3 (first fluid pressure chamber 91) to each other. The second fluid pressure passage 182 connects the suction passage 10 and the pump element 3 (second fluid pressure chamber 92) to each other.

The pump housing 2 includes a housing body and the pressure plate 2*c*. The housing body is divided into a front body 2*a* (first housing) and a rear body 2*b* (second housing). Division surfaces 200 of the front body 2*a* and the rear body 2*b* are substantially orthogonal to a rotational axis of the drive shaft 6. Hereinafter, constituent elements corresponding to the front body 2*a*, those corresponding to the rear body 2*b*, and those corresponding to the pressure plate 2*c* will be provided with reference numerals with subscripts a, b and c, respectively, in order to distinguish between the constituent elements. The front body 2*a* is provided with a receiving recess 20, a bolt hole 26*a*, an internal thread hole 27, a bearing retaining hole 28*a*, an oil seal seating hole 29, a suction pressure chamber 201, a discharge pressure chamber (high pressure chamber) 202, a spool valve housing hole 21, a portion 12*a* of the drain passage 12, the discharge passage 14, the control pressure passage 17, the first fluid pressure passage 181, and the first bearing lubrication passage 191. The receiving recess 20 has a shape of a bottomed cylinder including a bottom 20 and a cylindrical portion 211. The receiving recess 20 extends in the z-axis direction and opens in a z-axis positive direction side of the front body 2*a*. A surface 200*a* surrounds an opening of the receiving recess 20, which is formed in the z-axis positive direction side of the front body 2*a*. The surface 200*a* functions as a joined surface (division surface). The bolt hole 26*a* extends in the z-axis direction and has a shape of a bottomed cylinder whose z-axis positive direction end opens in the surface 200*a*. The bolt hole 26*a* has an inner periphery formed with an internal thread. A bolt 2*d* is screwed in the bolt hole 26*a*. The internal thread hole 27 extends in the x-axis direction. An x-axis negative direction end of the internal thread hole 27 opens in an inner peripheral surface of the receiving recess 20, whereas an x-axis positive direction end of the internal thread hole 27 opens in an outer peripheral surface of the front body 2*a*. The internal thread hole 27 has an inner periphery formed with an internal tread. A plug member 2*e* is screwed in the internal thread hole 27. The plug member 2*e* closes an opening of the internal thread hole 27, which is located in the outer peripheral surface of the front body 2*a*. A spring retaining hole 270 in a bottomed cylinder-like shape is formed in an inner peripheral side of the plug member 2*e*. The bearing retaining hole 28*a* has a cylindrical shape. The bearing retaining hole 28*a* extends in the z-axis direction. A z-axis positive direction side of the bearing retaining hole 28*a* opens in a z-axis positive direction-side surface of the bottom 20*a* of the receiving recess 20. A bearing (bushing) 2*g* is provided in an inner periphery of the bearing retaining hole 28*a*. A z-axis negative direction side of the drive shaft 6 is inserted in an inner peripheral side of the bearing 2*g* to be rotatably supported. The z-axis positive direction-side surface of the bottom 20*a* of the receiving recess 20 is formed with an annular seal groove 203 so that the annular seal groove 203 surrounds an outer periphery of the opening of the bearing retaining hole 28*a*. An annular seal member 2*f* is seated in the seal groove 203. The oil seal seating hole 29 is formed continuously in a z-axis negative direction side of the bearing retaining hole 28*a*. The oil seal seating hole 29 is formed into a shape of a cylinder having a larger diameter than the bearing retaining hole 28*a*. The oil seal seating hole 29 has a z-axis negative direction end which opens in the outer peripheral surface of the front body 2*a*. An oil seal 2*h* is seated in the oil seal seating hole 29. The oil seal 2*h* is in sliding contact with an outer peripheral surface of the drive shaft 6. The drive shaft 6 has an end portion projecting from the front body 2*a* (oil seal seating hole 29) in the z-axis negative direction. The end portion of the drive shaft 6 is rotationally driven by the crankshaft through a pulley. The suction pressure chamber 201 and the discharge pressure chamber 202 are recesses with bottoms, which are formed in the bottom 20*a* of the receiving recess 20. The suction pressure chamber 201 and the discharge pressure chamber 202 open in the z-axis positive direction-side surface of the bottom 20*a*. An annular seal groove 204 is formed in the z-axis positive direction-side surface of the bottom 20*a* of the receiving recess 20 so as to surround an outer periphery of the opening of the discharge pressure chamber 202. An annular seal member 2*i* is seated in the seal groove 204. The seal member 2*i* defines a high pressure area and a low pressure area which are respectively located on an inner peripheral side and an outer peripheral side of the seal member 2*i*.

The spool valve housing hole 21 functions as a valve housing portion. The spool valve housing hole 21 has a substantially cylindrical shape and extends in the x-axis direction (direction orthogonal to an axis center of the receiving recess 20) on the y-axis positive direction side of the receiving recess 20. The spool valve housing hole 21 has an x-axis positive direction end which opens in the outer peripheral surface of the front body 2*a*. An internal thread is formed in an inner periphery of the opening of the spool valve housing hole 21. A plug member 2*j* is screwed in the internal thread. The plug member 2*j* closes the opening of the spool valve housing hole 21. A spool valve retaining hole 210 having a bottomed cylinder-like shape is formed in an inner peripheral side of the plug member 2*j*. The portion 12*a* of the drain passage 12 extends in the z-axis direction. A z-axis negative direction end of the portion 12*a* opens in an inner peripheral surface of the spool valve housing hole 21, whereas a z-axis positive direction end of the portion 12*a* opens in the surface 200*a* of the front body 2*a*. The surface 200*a* is formed with an annular seal groove 205 so that the annular seal groove 205 surrounds the opening of the drain passage 12. An annular seal member (O-ring) 2*k* is seated in the seal groove 205. The discharge passage 14 extends in the y-axis direction. A y-axis negative direction side of the discharge passage 14 is connected to the discharge pressure chamber 202, whereas a y-axis positive direction end of the discharge passage 14 opens in the outer peripheral surface of the front body 2*a*. The control pressure passage 17 extends in the z-axis direction. The z-axis negative direction end of the control pressure passage 17 is connected through the pilot orifice 170 to the discharge passage 14, whereas a z-axis positive direction end of the control pressure passage 17 opens in the inner peripheral surface of the spool valve housing hole 21. The first fluid pressure passage 181 extends substantially in the y-axis direction. A y-axis positive direction end of the first fluid pressure passage 181 opens in the inner peripheral surface of the spool valve housing hole 21, whereas a y-axis negative direction end of the first fluid pressure passage 181 opens in the inner peripheral surface of the receiving recess 20. The first bearing lubrication passage 191 extends substantially in the z-axis direction. A z-axis positive direction end of the first bearing lubrication passage 191 is connected to the suction pressure chamber 201, whereas a z-axis negative direction end of the first bearing lubrication passage 191 opens in a bottom surface of the oil seal seating hole 29.

The pressure plate 2*c* has a shape of a circular disc and is made of, for example, an aluminum metal material. The pressure plate 2*c* may be produced by sintering of a ferrous material or another process. The pressure plate 2*c* is provided with a shaft receiving hole 28*c* and a positioning hole 209*c*. The shaft receiving hole 28*c* extends through a center portion of the pressure plate 2*c* in an axial direction. The positioning hole 209*c* extends through a rim portion of the pressure plate 2*c* in the axial direction. The pressure plate 2*c* has a z-axis positive direction-side surface provided with an inlet port 22*c*, an outlet port 23*c*, a suction-side back pressure port 24*c*, a discharge-side back pressure port 25*c*, and a communication opening 220. Hereinafter, a direction around an axis center of the shaft receiving hole 28*c* will be referred to as a circumferential direction. The inlet port 22*c* and the outlet port 23*c* are grooves extending in the circumferential direction to form a substantially arc-like shape. The inlet port 22*c* and the outlet port 23*c* are opposite to each other with the shaft receiving hole 28*c* located therebetween. The suction-side back pressure port 24*c* is a groove located on the shaft receiving hole 28*c* side (radially inward side) of the inlet port 22*c* and extending in the circumferential direction to form a substantially arc-like shape. The suction-side back pressure port 24*c* is located within an area circumferentially overlapping the inlet port 22*c*. The discharge-side back pressure port 25*c* is a groove located on a radially inward side of the outlet port 23*c* and extending in the circumferential direction to form a substantially arc-like shape. The discharge-side back pressure port 25*c* is located within an area circumferentially overlapping the outlet port 23*c*. The discharge-side back pressure port 25*c* has a circumferential end in communication with a circumferential end of the suction-side back pressure port 24*c*. The communication opening 220 is a groove which opens on a radially outward side of the outlet port 23*c*. The communication opening 220 is located within an area circumferentially overlapping the outlet port 23*c*. The pressure plate 2*c* is provided in the bottom 20*a* of the receiving recess 20 of the front body 2*a*. The z-axis positive direction-side surface of the pressure plate 2*c* faces the opening side (z-axis positive direction side) of the receiving recess 20. A z-axis negative direction-side surface of the pressure plate 2*c* faces the bottom 20*a* of the receiving recess 20. The shaft receiving hole 28*c* of the pressure plate 2*c* faces the bearing retaining hole 28*a* of the front body 2*a*. The inlet port 22*c* and the communication opening 220 are connected to the suction pressure chamber 201 of the front body 2*a* through communication holes 30 and 31. The communication hole 30 has four communication hole portions 301, 302, 303 and 304 extending through the pressure plate 2*c* in the axial direction. The communication hole 31 has two communication hole portions 311 and 312 extending through the pressure plate 2*c* in the axial direction. The outlet port 23*c* and the discharge-side back pressure port 25*c* are connected to the discharge pressure chamber 202 of the front body 2*a* through a communication hole 32. The communication hole 32 has four communication hole portions 321, 322, 323 and 324 extending through the pressure plate 2*c* in the axial direction. The z-axis negative direction-side surface of the pressure plate 2*c* is formed with an annular seal groove 206 so that the annular seal groove 206 extends along an outer rim of the pressure plate 2*c*. An annular seal member (O-ring) 21 is seated in the seal groove 206. The seal member 2*l* prevents the hydraulic fluid from leaking through a gap on an outer peripheral side of the pressure plate 2*c*.

The rear body 2*b* is secured to the z-axis positive direction side of the front body 2*a* to seal the receiving recess 20. A fit portion 207 and a surface 200*b* are formed in a z-axis negative direction-side surface of the rear body 2*b*, which is the side secured to the front body 2*a*. The fit portion 207 is formed into a substantially column-like shape and has a flat surface in a substantially circular shape. The surface 200*b* encloses the fit portion 207. The fit portion 207 protrudes relative to the surface 200*b*. The fit portion 207 is fitted in the opening of the receiving recess 20. The surface 200*b* is joined to the surface 200*a* of the front body 2*a*. The fit portion 207 has an outer peripheral surface which is formed with an annular seal groove 208 so that the annular seal groove 208 encloses the fit portion 207. An annular seal member (O-ring) 2*m* is seated in the seal groove 208. The seal member 2*m* prevents the hydraulic fluid from leaking through a gap between the joined surfaces 200*a* and 200*b*. The rear body 2*b* is provided with a bolt hole 26*b*, a bearing retaining hole 28*b*, the suction passage 10, a portion 12*b* of the drain passage 12, the second fluid pressure passage 182, and the second bearing lubrication passage 192. The bolt hole 26*b* extends in the z-axis direction to pass through the rear body 2*b*, and a z-axis positive direction end of the bolt hole 26*b* opens in the surface 200*b*. The bolt hole 26*b* is inserted with the bolt 2*d*. The rear body 2*b* is fastened to the front body 2*a* with the bolt 2*d*. The bearing retaining hole 28*b* is formed into a shape of a bottomed cylinder and extends in the z-axis direction. A bearing (bushing) 2*n* is disposed in an inner periphery of the bearing retaining hole 28*b*. A z-axis positive direction end of the drive shaft 6 is inserted in an inner peripheral side of the bearing 2*n* to be rotatably supported. The rear body 2*b* (fit portion 207) has a z-axis negative direction end surface which is formed with the inlet port 22*b*, the outlet port 23*b*, the suction-side back pressure port 24*b*, and the discharge-side back pressure port 25*b*. The inlet port 22*b*, the outlet port 23*b*, the suction-side back pressure port 24*b*, and the discharge-side back pressure port 25*b* are located in positions substantially corresponding in the z-axis direction to the openings 22*c* and 23*c* and the ports 24*c* and 25*c* of the pressure plate 2*c*, respectively. The inlet port 22*b*, the outlet port 23*b*, the suction-side back pressure port 24*b*, and the discharge-side back pressure port 25*b* have similar shapes to the openings 22*c* and 23*c* and the ports 24*c* and 25*c*, respectively. The second fluid pressure passage 182 has an opening which is located in a position substantially corresponding to an opening of the communication opening 220 in the z-axis direction, which is formed in the pressure plate 2*c*. The opening of the second fluid pressure passage 182 has a similar shape to the opening of the communication opening 220.

The suction passage 10 includes a large-diameter passage 100 and a small-diameter passage 101. The large-diameter passage 100 is a passage with a relatively large diameter, which extends in the y-axis direction and has a bottomed cylinder-like shape. The large-diameter passage 100 has a y-axis positive direction end which opens in an outer peripheral surface of the rear body 2*b*. The opening of the large-diameter passage 100 is connected with a suction pipe, not shown. The large-diameter passage 100 is connected to the reservoir tank RES through the suction pipe. The small-diameter passage 101 is a passage with a relatively small diameter, which extends in the z-axis direction. A z-axis negative direction end of the small-diameter passage 101 opens in a bottom surface of the inlet port 22*b*, whereas a z-axis positive direction end of the small-diameter passage 101 opens in an inner peripheral surface of the large-diameter passage 100. The second fluid pressure passage 182 extends in the z-axis direction. A z-axis negative direction end of the second fluid pressure passage 182 opens in a z-axis negative direction end surface of the rear body 2*b* (fit portion 207), whereas a z-axis positive direction end of the second fluid pressure passage 182 opens in the inner peripheral surface of the large-diameter passage 100. The portion 12*b* of the drain passage 12 extends in the z-axis direction. A z-axis positive direction end of the portion 12*b* opens in the inner peripheral surface of the large-diameter passage 100, whereas a z-axis negative direction end of the portion 12*b* opens in the surface 200*b* of the rear body 2*b*. The portion 12*b* of the drain passage 12 faces the portion 12*a* of the drain passage 12 in the z-axis direction, which is located on the front body 2*a* side. The portions 12*a* and 12*b* are connected to each other to form the single drain passage 12. The drain passage 12 is formed across the division surfaces (joined surfaces) 200*a* and 200*b*. The seal member 2*k* prevents the hydraulic fluid from leaking from the drain passage 12 through a gap between the joined surfaces 200*a* and 200*b*. The second bearing lubrication passage 192 extends in the y-axis direction. A y-axis positive direction end of the second bearing lubrication passage 192 opens in the bottom surface of the large-diameter passage 100, whereas a y-axis negative direction end of the second bearing lubrication passage 192 opens in the inner peripheral surface of the bearing retaining hole 28*b*.

The adapter ring 7 is seated in the receiving recess 20 of the front body 2*a* to be located on the z-axis positive direction side of the pressure plate 2*c*. The adapter ring 7 has a substantially ring-like shape and has an outer periphery which is fitted in an inner periphery of the receiving recess 20. The adapter ring 7 has an inner peripheral surface which is formed in a substantially cylinder-like shape extending in the z-axis direction. The inner peripheral surface of the adapter ring 7 has a substantially elliptical shape as viewed in the z-axis direction. The inner peripheral surface of the adapter ring 7 includes a first groove 71, a second groove 72, a first flat surface 73, a second flat surface 74, a plate member 75, and a spring installation hole 76. The first flat surface 73 is formed in a y-axis positive direction side and includes a flat surface extending in the z-axis direction while facing the center (rotational axis 0) of the adapter ring 7. The first groove 71 is formed in the first flat surface 73 and extends in the z-axis direction. The first fluid pressure passage 181 is disposed adjacent to an x-axis negative direction side of the first groove 71. The first fluid pressure passage 181 extends through the adapter ring 7 in a radial direction. The plate member 75 has a flat surface extending in the z-axis direction while facing the rotational axis 0. The plate member 75 is located in such a position to face the first flat surface 73 across the rotational axis 0. The second groove 72 has a shape of a semicylinder extending in the z-axis direction. The second groove 72 is formed adjacent to an x-axis positive direction side of the plate member. The second flat surface 74 is located in an x-axis negative direction side and has a flat surface extending in the z-axis direction while facing the rotational axis 0. The second flat surface 74 is located between the first flat surface 73 and the plate member 75 in the circumferential direction of the adapter ring 7 (substantially middle position). The spring installation hole 76 is located on an x-axis positive direction side in such a position as to face the second flat surface 74 across the rotational axis 0. The spring installation hole 76 extends through the adapter ring 7 in the radial direction. The pump element 3 is housed in a space enclosed by the inner peripheral surface of the adapter ring 7, the z-axis positive direction-side surface of the pressure plate 2*c*, and the z-axis negative direction-side surface of the rear body 2*b* (fit portion 207). The space thus functions as a pump element housing portion.

The pump element 3 includes a rotor 8, a vane 81, and cam ring 9. The rotor 8 is coupled to the drive shaft 6 through a serration and rotationally driven by the drive shaft 6. The rotor 8 is provided with a plurality of (eleven) slits 80. Hereinafter, a direction around a rotational axis 0 of the rotor 8 will be referred to as a circumferential direction. The plurality of slits 80 are circumferentially arranged in an outer periphery of the rotor 8 and each extend in a substantially radial direction. The plurality of slits 80 are in the form of cutouts arranged at substantially regular intervals in the circumferential direction. The slits 80 may be inclined, as viewed in the z-axis direction, with respect to radial straight lines intersecting the rotational axis 0. A back pressure chamber 80*a* is formed in a radially inward side of each of the slits 80. The vanes 81 each having a substantially flat plate-like shape are housed in the respective slits 80. The vanes 81 are projectably/retractably housed in the slits 80 and allowed to move into and out of the slits 80. The cam ring 9 is formed to have a substantially ring-like shape. The cam ring 9 has an inner peripheral surface which is formed in a substantially cylinder-like shape. The cam ring 9 has an outer peripheral surface which is formed with a semicylinder-shaped groove 93 extending in the z-axis direction. The cam ring 9 is disposed within the pump element housing portion so as to enclose the rotor 8. The cam ring 9 forms a plurality of pumping chambers 82 together with the rotor 8 and the vanes 81. More specifically, the pressure plate 2*c* and the rear body 2*b* (fit portion 207) are disposed in axial side surfaces of the cam ring 9 and the rotor 8. An annular space between the inner peripheral surface of the cam ring 9 and the outer peripheral surface of the rotor 8 is sealed at both axial sides by the pressure plate 2*c* and the rear body 2*b* (fit portion 207). The annular space is divided into eleven pumping chambers 82 by the plurality of vanes 81. The vanes 81 separate the annular space in the circumferential direction to form the plurality of pumping chambers 82 together with the cam ring 9 and the rotor 8.

The cam ring 9 is movable in an x-y plane within the pump element housing portion. A pin 2*o* is fitted between the second groove 72 of the adapter ring 7 and the groove 93 of the cam ring 9. The pin 2*o* has one end side extending through the positioning hole 209*c* of the pressure plate 2*c*. The one end side of the pin 2*o* is secured in a positioning hole 209*a* formed in the front body 2*a*. The other end side of the pin 2*o* is secured in a positioning hole, not shown, which is formed in the rear body 2*b*. The pin 2*o* prevents or limits rotation of the pressure plate 2*c* with respect to the housing body. The pin 2*o* further prevents or limits rotation of the adapter ring 7 with respect to the pump housing 2 and further prevents or limits rotation of the cam ring 9 with respect to the adapter ring 7. The cam ring 9 is disposed on an inner peripheral side of the adapter ring 7 so as to be swingingly movable with respect to the pump housing 2. The cam ring 9 is supported against the adapter ring 7 by the plate member 75. The cam ring 9 rotates on the plate member 75 and swingingly moves by using the plate member 75 as a supporting point. Hereinafter, an amount by which the center (axis center) P of the inner peripheral surface of the cam ring 9 is displaced from the center (rotational axis 0) of the rotor 8 (drive shaft 6) will be referred to as an eccentricity amount 6. The cam ring 9 is disposed in an outer peripheral side of the rotor 8 so as to be swingingly movable in such a direction that the eccentricity amount 8 relative to the rotor 8 is changed.

The rotor 8 rotates counterclockwise as viewed in FIGS. 1 and 3. When the center P of the cam ring 9 is eccentric to the rotational axis 0 (toward the x-axis negative direction side), a radial distance between the outer peripheral surface of the rotor 8 and the inner peripheral surface of the cam ring 9 (radial dimension of each of the pumping chambers 82) increases as the center P is displaced from the x-axis positive direction side toward the x-axis negative direction side. The vanes 81 move out of the slits 80 and move back to the slits 80 toward the inner peripheral surface of the cam ring 9 as the distance changes, to thereby separate the pumping chambers 82 from one another. The pumping chambers 82 on the x-axis negative direction side increase more in volume than the pumping chambers 82 on the x-axis positive direction side. Due to the difference in volumes of the pumping chambers 82, the volumes of the pumping chambers 82 increase on the y-axis positive direction side of the rotational axis 0 as the rotor 8 rotates (as the pumping chambers 82 travel in the x-axis negative direction), and the volumes of the pumping chambers 82 decrease on the y-axis negative direction side of the rotational axis 0 as the rotor 8 rotates (as the pumping chambers 82 travel in the x-axis positive direction). The volumes of the pumping chambers 82 periodically increase and decrease while rotating counterclockwise around the rotational axis 0. The inlet port 22 opens into the suction area where the volumes of the pumping chambers 82 increase with the rotation of the rotor 8 (drive shaft 6). The outlet port 23 opens into a discharge area where the volumes of the pumping chambers 82 decrease with the rotation of the rotor 8.

A seal member 2*p* is seated in the first groove 71 of the adapter ring 7. When the cam ring 9 swingingly moves, the plate member 75 of the adapter ring 7 comes into contact with the outer peripheral surface of the cam ring 9, and the seal member 2*p* also comes into contact with the outer peripheral surface of the cam ring 9. The seal member 2*p* seals a space between the adapter ring 7 and the cam ring 9. The plate member 75 functions not only as a swing supporting point of the cam ring 9 but also as a seal member for sealing the space between the cam ring 9 and the adapter ring 7. The space between the inner peripheral surface of the adapter ring 7 and the outer peripheral surface of the cam ring 9 is divided into a pair of spaces in a liquid-tight manner by the plate member 75 (contact portion between the plate member 75 and the outer peripheral surface of the cam ring 9) and the seal member 2*p*. In other words, the fluid pressure chambers 91 and 92 are formed as the pair of spaces between the cam ring 9 and the pump element housing portion to be located on both radial sides of the cam ring 9. On the outer peripheral side of the cam ring 9, the first fluid pressure chamber 91 is formed on the x-axis negative direction side where the eccentricity amount 8 increases, and the second fluid pressure chamber 92 is formed on the x-axis positive direction side where the eccentricity amount 6 decreases. Along with the displacement of the cam ring 9 toward the side where the eccentricity amount 8 increases, the volume of the first fluid pressure chamber 91 is decreased, and the volume of the second fluid pressure chamber 92 is increased. A spring 94 is installed in the second fluid pressure chamber 92 so that one end of the spring 94 is disposed in the outer periphery of the cam ring 9. The spring 94 extends through the spring installation hole 76 of the adapter ring 7 and is retained in the spring retaining hole 270 of the plug member 2*e*. The other end of the spring 94 is disposed in a bottom surface of the spring retaining hole 270. The spring 94 is installed in a contracted position and normally biases the cam ring 9 against the adapter ring 7 in the x-axis negative direction (toward the first fluid pressure chamber 91). The displacement of the cam ring 9 in the x-axis negative direction is regulated by the outer peripheral surface of the cam ring 9 coming into contact with the second flat surface 74 of the adapter ring 7 within the first fluid pressure chamber 91.

The control valve 4 includes the spool valve housing hole 21, a spool valve 40, a high pressure chamber 41, a control pressure chamber 42, a low pressure chamber 43, and a control valve spring 44. The spool valve 40 is a valve element (spool) which is so disposed as to be movable in the x-axis direction within the spool valve housing hole 21. The spool valve 40 has a substantially bottomed cylinder-like shape. A cross-section of the spool valve 40 along a plane orthogonal to a direction in which an axis center of the spool valve 40 extends (moving direction of the spool valve 40) has a substantially circular outer shape. The spool valve 40 includes a relief valve housing hole 403 in an inner peripheral side thereof. The relief valve housing hole 403 has an inner peripheral surface which is formed into a substantially circular shape in cross-section along the plane mentioned above. The relief valve housing hole 403 is closed at one x-axis direction side and open at the other x-axis direction side. A spring retaining portion 405 is disposed in an end portion (bottom) of the one x-axis direction side of the relief valve housing hole 403. The spring retaining portion 405 is slightly smaller in diameter than other axial areas of the relief valve housing hole 403. The spool valve 40 is housed within the spool valve housing hole 21 so that the other x-axis direction side (opening) of the relief valve housing hole 403 is positioned on the x-axis positive direction side. The spool valve 40 moves in the x-axis direction. A tapered portion 406 is formed in an outer peripheral side of an x-axis negative direction end portion of the spool valve 40. The tapered portion 406 is so formed that a diameter centered at an axis center of the spool valve 40 is reduced toward the x-axis negative direction side.

The spool valve 40 includes a shaft portion 400, a first land portion 401, and a second land portion 402. The land portions 401 and 402 are larger in external diameter than the shaft portion 400. The external diameter of each of the land portions 401 and 402 is slightly smaller than a bore diameter of the spool valve housing hole 21. The first land portion 401 is slightly offset from an x-axial center of the spool valve 40 toward the x-axis negative direction. The second land portion 402 is disposed in an opening located at an x-axis positive direction end of the spool valve 40. The land portions 401 and 402 include grooves 401*a* and 402*a*, respectively, which extend in the circumferential direction, where a direction along the outer shape of the substantially circular cross-section of the spool valve 40 (direction around the axis center of the spool valve 40) is a circumferential direction. The shaft portion 400 between the first land portion 401 and the second land portion 402 is provided with a plurality of (four in the present embodiment) communication passages (relief holes) 404. The spool valve 40 divides an interior portion of the spool valve housing hole 21 into the high pressure chamber 41, the control pressure chamber 42, and the low pressure chamber 43. The high pressure chamber 41 is a space inside the spool valve housing hole 21 and disposed on the x-axis negative direction side of the spool valve 40. The high pressure chamber 41 is a space enclosed chiefly by the inner peripheral surface of the spool valve housing hole 21, an x-axis negative direction-side surface of the plug member 2*j* (spool valve retaining hole 210), an x-axis negative direction-side surface of the first land portion 401, and an outer peripheral surface of the shaft portion 400, which is located on the x-axis negative direction side of the first land portion 401. Regardless of an x-axial motion of the spool valve 40 within the spool valve housing hole 21, the high pressure passage 15 opens into the high pressure chamber 41. The control pressure chamber 42 is a space within the spool valve housing hole 21 and located on the x-axis positive direction side of the spool valve 40. The control pressure chamber 42 is a space enclosed chiefly by the inner peripheral surface of the spool valve housing hole 21, an x-axis positive direction-side surface of the second land portion 402, an inner peripheral surface of the shaft portion 400, which is located on the x-axis positive direction side (opening side of the relief valve housing hole 403), and an x-axis positive direction end surface of a valve sheet member 51 mentioned later. Regardless of the x-axial motion of the spool valve 40, the control pressure passage 17 opens into the control pressure chamber 42.

The low pressure chamber 43 is a space within the spool valve housing hole 21 and formed on the outer peripheral side of the spool valve 40. The low pressure chamber 43 is created between the high pressure chamber 41 and the control pressure chamber 42 in the x-axis direction. The low pressure chamber 43 is a space enclosed chiefly by the inner peripheral surface of the spool valve housing hole 21, an x-axis positive direction-side surface of the first land portion 401, an x-axis negative direction-side surface of the second land portion 402, and an outer peripheral surface of the shaft portion 400, which is located between the land portions 401 and 402. The low pressure chamber 43 is normally not in communication with the high pressure chamber 41 by the presence of the first land portion 401 and normally not in communication with the control pressure chamber 42 by the presence of the second land portion 402. Regardless of the x-axial motion of the spool valve 40, the drain passage 12 opens into the low pressure chamber 43. The communication passage 404 normally connects the relief valve housing hole 403 and the low pressure chamber 43 to each other. The first fluid pressure passage 181 is connected to the spool valve housing hole 21 at a point on the x-axis positive direction side of the high pressure passage 15 and yet on the x-axis negative direction side of the drain passage 12. The first fluid pressure passage 181 extends through the adapter ring 7 to be connected to the first fluid pressure chamber 91. The control valve spring 44 is installed in a contracted position on the x-axis positive direction side of the spool valve 40 (control pressure chamber 42) within the spool valve housing hole 21. An x-axis negative direction end of the control valve spring 44 is in contact with an x-axis positive direction end portion of the spool valve 40 (surface enclosing the opening of the relief valve housing hole 403). An x-axis positive direction end of the control valve spring 44 is in contact with a bottom of the spool valve housing hole 21, which is located on the x-axis positive direction side. The control valve spring 44 normally biases the spool valve 40 toward the x-axis negative direction side (opposite side from the plug member 2*j*).

The relief valve 5 is a valve portion disposed inside the pump housing 2. The relief valve 5 is housed in the spool valve housing hole 21. Specifically, the relief valve 5 is disposed in the inside (relief valve housing hole 403) of the spool valve 40. The relief valve 5 includes a ball 50, a valve sheet member 51, a retainer 52, and a relief valve spring 53. The ball 50 is a spherical valve element. The valve sheet member 51 is a column-shaped valve seat member and has a substantially circular outer shape in cross-section along a plane orthogonal to a direction in which an axis center of the valve sheet member 51 extends. The valve sheet member 51 has an external diameter which is substantially equal to an internal diameter of the relief valve housing hole 403. The valve sheet member 51 has a through-hole 510. The through-hole 510 extends through the valve sheet member 51 along a substantial axis center of the valve sheet member 51. The communication passage 404 opens in an inner peripheral surface of the relief valve housing hole 403 at a position on the x-axis negative direction side of a point at which the valve sheet member 51 is secured. The through-hole 510 leads to the control pressure chamber 42 through the opening located on an x-axis positive direction side of the relief valve housing hole 403 and is communicated with the discharge passage 14 through the control pressure passage 17. The ball 50 is located in an x-axis negative direction side of the valve sheet member 51 to be on the side opposite to an x-axis positive direction-side end surface (sheet surface) of the valve sheet member 51. The retainer 52 is a valve element retaining member for retaining the ball 50. The ball 50 is located in an x-axis positive direction side of the retainer 52 to be on the side opposite to an x-axis negative direction-side end surface (ball retaining surface) of the retainer 52. The relief valve spring 53 is a coil spring and installed on the x-axis negative direction side of the retainer 52. A part of the retainer 52 is inserted in an inner peripheral side of the relief valve spring 53 on the x-axis positive direction side. An x-axis negative direction-side end portion of the relief valve spring 53 is located on an inner peripheral side of the spring retaining portion 405. An x-axis negative direction-side end of the relief valve spring 53 is in contact with an x-axis negative direction-side bottom of the relief valve housing hole 403. An x-axis positive direction-side end of the relief valve spring 53 is in contact with the retainer 52. The relief valve spring 53 is so provided as to be normally in a contractively deformed position. The retainer 52 normally biases the ball 50 toward the valve sheet member 51 due to a restoring force created by the contractive deformation of the relief valve spring 53. The retainer 52 is disposed between the ball 50 and the relief valve spring 53 to retain the ball 50.

Figure 6:
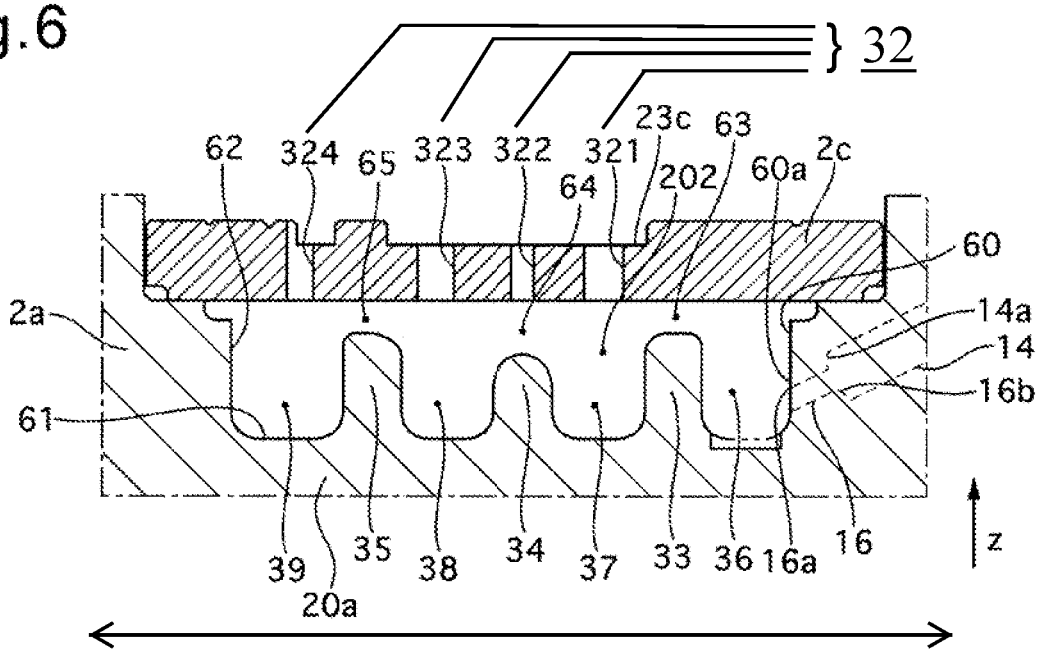
FIG. 6 is a cross-section along line S6-S6 of FIG. 4.

FIG. 6 is a cross-section along line S6-S6 of FIG. 4.

The metering orifice 16 has one end-side opening 16*a* which opens in one circumferential end-side (right side on FIG. 6) inner peripheral surface 60 of the discharge pressure chamber 202. The one circumferential end-side inner peripheral surface 60 includes a predetermined region which has the one end-side opening 16*a*. The predetermined region is provided with a machined surface 60*a* grinded by machining. The other end-side opening 16*b* of the metering orifice 16 is connected to one end-side opening 14*a* of the discharge passage 14. The discharge pressure chamber 202 has a bottom surface 61 which is provided with three straightening vanes (ribs) 33, 34 and 35 arranged to stand in the z-axis positive direction. The straightening vanes 33, 34 and 35 are spaced from each other in the circumferential direction. Each of the straightening vanes 33, 34 and 35 connects a pair of radially opposite regions which are part of the inner peripheral surface of the discharge pressure chamber 202. The straightening vanes 33, 34 and 35 comprise a first straightening vane (first rib) 33, a second straightening vane (second straightening vane) 34, and a third straightening vane (third straightening vane) 35 arranged in the order named from the one circumferential end side toward the other circumferential end side (from right to left as viewed in FIG. 6). The first straightening vane 33 and the third straightening vane 35 are equal in height (z-axial length from the bottom surface 61). The second straightening vane 34 is lower in height than the first and third straightening vanes 33 and 35. There is a gap between each of the straightening vanes 33, 34 and 35 and the pressure plate 2*c* in the z-axis direction. Spaces comprising the above-mentioned gaps between the respective straightening vanes 33, 34 and 35 and the pressure plate 2*c* function as contracted portions 63, 64 and 65 which primarily straighten the hydraulic fluid.

The communication hole portions 321, 322, 323 and 324 of the pressure plate 2*c* comprise a first communication hole portion 321, a second communication hole portion 322, a third communication hole portion 323, and a fourth communication hole portion 324 arranged in the order named from the one circumferential end side toward the other circumferential end side. The first straightening vane 33 is disposed on the one circumferential side of the first communication hole portion 321. That is, the first straightening vane 33 does not face the communication hole 32 in the z-axis direction. The one end-side opening 16*a* of the metering orifice 16 is deviated (offset) from the first contracted portion 63 in the z-axis direction. The second straightening vane 33 is so disposed as to face the second communication hole portion 322 in the z-axis direction. The third straightening vane 35 is disposed between the third communication hole portion 323 and the fourth communication hole portion 324 in the circumferential direction. In other words, the third straightening vane 35 does not face the communication hole 32 in the z-axis direction. The discharge pressure chamber 202 includes four chamber sections 36, 37, 38 and 39 which primarily function to reduce pressure pulsation of the hydraulic fluid. The chamber sections 36, 37, 38 and 39 are separated from each other by the straightening vanes 33, 34 and 35. The first chamber section 36 is disposed between the one circumferential end-side inner peripheral surface 60 of the discharge pressure chamber 202 and the first straightening vane 33 in the circumferential direction. Sectional area of a hydraulic-fluid flow channel of the first chamber section 36 is larger than sectional area of the first contracted portion 63 and that of the one end-side opening 16*a* of the metering orifice 16. The second chamber section 37 is disposed between the first and second straightening vanes 33 and 34 in the circumferential direction. The third chamber section 38 is disposed between the second and third straightening vanes 34 and 35 in the circumferential direction. The fourth chamber section 39 is disposed between the third straightening vane 35 and the other circumferential end-side inner peripheral surface 62 of the discharge pressure chamber 202 in the circumferential direction.

Performance of the pump 1 will be now discussed.

The rotor 8 is rotationally driven by the drive shaft 6 in the counterclockwise direction as viewed in FIGS. 1 and 3. At this time, each of the pumping chambers 82 makes an orbital motion while increasing and decreasing its own volume, creating pumping work. The hydraulic fluid is delivered to the suction passage 10 through the suction pipe connected to the reservoir tank RES. The hydraulic fluid in the suction area is sucked into the pumping chambers 82 by pump suction. The hydraulic fluid discharged from the pumping chambers 82 by pump discharge is discharged out of the pump housing 2 through the discharge pressure chamber 202 and the discharge passage 14, and then delivered to the power cylinder of the power steering system. The pressure plate 2*c* is pressed toward the rotor 8 by the pressure in the discharge pressure chamber 202 to function as a pressure plate. The inlet ports 22*b* and 22*c* and the outlet ports 23*b* and 23*c* are respectively positioned in a substantially symmetric manner in the z-axis direction across the respective pumping chambers 82. This improves pressure balance between both axial sides of each of the pumping chambers 82. The hydraulic fluid in the discharge pressure chamber 202 is delivered to the discharge-side back pressure ports 25*b* and 25*c* and the suction-side back pressure ports 24*b* and 24*c*. The back pressure chamber 80*a* of each of the slits 80 is in communication with the back pressure ports 24 and 25. The vanes 81 are pushed against the inner peripheral surface of the cam ring 9 by the pressure of the hydraulic fluid delivered into the back pressure chambers 80*a*. The suction pressure chamber 201 is in communication with the oil seal seating hole 29 through the first bearing lubrication passage 191. An excessive amount of hydraulic fluid in an oil seal 2*h* is supplied to the pumping chambers 82 due to the pump suction in the suction area. This prevents the excessive amount of hydraulic fluid from leaking from the oil seal 2*h* to the outside of the pump housing 2.

The control valve 4 controls the pressure in the first fluid pressure chamber 91, to thereby function as a control mechanism for controlling the eccentricity amount 6 of the cam ring 9 with respect to the rotor 8. The control valve 4 controls the eccentricity amount 6, to thereby function as a pressure controlling device for controlling pump discharge pressure. Pressure is relatively high on an upstream side of the metering orifice 16 in the discharge passage 14, and this relatively high pressure (hereinafter, referred to as high pressure) is delivered through the high pressure passage 15 into the high pressure chamber 41 of the control valve 4. Pressure is relatively low on a downstream side of the metering orifice 16 in the discharge passage 14, and this relatively low pressure (medium pressure, which will be hereinafter referred to as control pressure) is delivered through the control pressure passage 17 into the control pressure chamber 42. Low pressure (pump suction pressure) is delivered from the suction passage 10 through the drain passage 12 into the low pressure chamber 43. A communication state between the high pressure chamber 41 and the first fluid pressure chamber 91 is switched when the spool valve 40 moves in the x-axis direction according to pressure difference between the control pressure chamber 42 and the high pressure chamber 41 (differential pressure between the high pressure and the control pressure). In other words, the control valve 4 switches a state of hydraulic fluid supply through the first fluid pressure passage 181 to the first fluid pressure chamber 91. The low pressure (pump suction pressure) is constantly delivered to the second fluid pressure chamber 92 through the second fluid pressure passage 182. The eccentricity amount 8 increases and decreases in response to swing or oscillation of the cam ring 9, which is caused by pressure difference between the fluid pressure chambers 91 and 92.

In an initial state where the spool valve 40 is displaced to the maximum toward the x-axis negative direction side, an opening of the first fluid pressure passage 181, which is formed in the spool valve housing hole 21, is disconnected from the high pressure chamber 41 by the presence of the first land portion 401 and comes into communication with the low pressure chamber 43. The first fluid pressure chamber 91 is therefore not supplied with the high pressure but supplied with the low pressure in common with the second fluid pressure chamber 92. The cam ring 9 thus comes into an eccentric position. To be more specific, the biasing force of the spring 94 moves the cam ring 9 to such a position that the eccentricity amount 8 reaches its maximum. This increases the pump capacity, so that a pump discharge rate grows according to rotation frequency. If the pressure difference between the control pressure chamber 42 and the high pressure chamber 41 increases according to the growth of the discharge rate, the spool valve 40 moves in the x-axis positive direction against the biasing force of the control valve spring 44. If the spool valve 40 moves a predetermined or larger amount in the x-axis positive direction, the opening of the first fluid pressure passage 181 is gradually disconnected from the low pressure chamber 43 by the first land portion 401 and comes into communication with the high pressure chamber 41. The flow channel is therefore switched to cause the hydraulic fluid in the high pressure chamber 41 to flow through the first fluid pressure passage 181 into the first fluid pressure chamber 91. The first fluid pressure chamber 91 is supplied with the high pressure, whereas the second fluid pressure chamber 92 remains under the low pressure. The pressure of the first fluid pressure chamber 91 causes the cam ring 9 to swingingly move against the biasing force of the spring 94 in such a direction that the capacity of the second fluid pressure chamber 92 is decreased. This reduces the eccentricity amount 8 and thus decreases the pump capacity. Therefore, the increase in pump rotation frequency does not increase the pump discharge rate.

More specifically, the spool valve 40 switches the flow channel according to the differential pressure between the upstream and downstream sides of the metering orifice 16 (discharge rate). Fluid pressure of the low pressure chamber 43 or that of the high pressure chamber 41 is selectively delivered to the first fluid pressure chamber 91. If the hydraulic fluid in the high pressure chamber 41 is delivered into the first fluid pressure chamber 91, the flow rate supplied to the power cylinder through the discharge passage 14 is limited to a necessary rate. As described above, the metering orifice 16, the high pressure passage 15, the control pressure passage 17, the spool valve 40, the first fluid pressure passage 181, the second fluid pressure passage 182, the first fluid pressure chamber 91, and the second fluid pressure chamber 92 function as a controller which controls the discharge rate of the pump element 3. The communication state between the control pressure chamber 42 and the first fluid pressure chamber 91 may be switched by the x-axial motion of the spool valve 40. The control valve 4 may control the eccentricity amount 8 by adjusting the pressure in the second fluid pressure chamber 92 (together with or instead of the pressure in the first fluid pressure chamber 91). For example, the eccentricity amount 8 may also be controlled by switching a communication state between the control pressure chamber 42 and the second fluid pressure chamber 92.

When the pressure in the control pressure chamber 42 (pressure on the discharge passage 14 side) exceeds the predetermined pressure, that is, when the pressure (load pressure) on the power steering system side (load side) exceeds the predetermined pressure, the relief valve 5 is shifted into a relief position to return the hydraulic fluid to the suction passage 10 through the low pressure chamber 43 and the drain passage 12. This makes it possible to prevent the excessive increase of the load pressure.

[Reduction of Fluctuation in Discharge Rate]

Referring to FIG. 6, the hydraulic fluid pressurized in the pumping chambers 82 enters the discharge pressure chamber 202 from the communication hole portions 321, 322, 323 and 324 of the pressure plate 2*c*. The hydraulic fluid which has entered the discharge pressure chamber 202 is reduced in pressure pulsation in the chamber sections 36, 37, 38 and 39. After being straightened by the contracted portions 63, 64 and 65, the hydraulic fluid is delivered from the metering orifice 16 to the discharge passage 14 and then supplied to the power cylinder of the power steering system.

According to the present embodiment, the first straightening vane 33 located on the most downstream side (closest to the metering orifice 16) among all the straightening vanes 33, 34 and 35 is disposed on the downstream side (one circumferential side on FIG. 6) of the first communication hole portion 321 located on the most downstream side among all the communication hole portions 321, 322, 323 and 324. The first straightening vane 33 therefore does not face the communication hole portions 321, 322, 323 and 324 in the z-axis direction. If the first straightening vane and the first communication hole portion face each other in the axial direction of the pump, the hydraulic fluid which has entered the discharge pressure chamber from the first communication hole portion and the hydraulic fluid which has entered the discharge pressure chamber from the other communication hole portions join together at the first contracted portion. Along with this interflow, especially when the pump rotation frequency is changed, fluctuation occurs in the pressure of the hydraulic fluid passing through the first contract portion, resulting in an insufficient straightening effect. Since the first contracted portion is located on the most downstream side among all the contracted portions, the first contracted portion has a major effect on the pressure on the upstream side of the metering orifice. If the first contracted portion fails to provide a sufficient straightening effect, fluctuation occurs in the pressure on the upstream side of the metering orifice. The fluctuation in the pressure on the upstream side of the metering orifice makes unstable the position of the spool valve of the control valve. This causes the cam ring to swingingly move and thus fluctuates the discharge rate of the pump. Conventional variable displacement vane pumps are not at all designed to solve the foregoing issue.

In contrast, according to the pump 1 of the present embodiment, the hydraulic fluid passing through the first contracted portion 63 forms a single flow. This reduces the fluctuation in the pressure of the hydraulic fluid passing through the first contracted portion 63. A sufficient straightening effect therefore can be exerted by the first contracted portion 63, which reduces the fluctuation in the pressure on the upstream side of the metering orifice 16 (pressure in the first chamber section 36). This makes it possible to reduce the fluctuation in the discharge rate in the situation where the rotation frequency of the pump 1 is changed. Furthermore, since there is no communication hole on the downstream side of the first straightening vane 33, and the hydraulic fluid which enters the first chamber section 36 forms a single flow, a sufficient pulsation-reducing effect can be exerted by the first chamber section 36.

The communication hole 32 of the pressure plate 2*c* includes the four communication hole portions 321, 322, 323 and 324. As compared to a case in which the communication hole 32 is a single hole, it is possible to reduce the diameters of the communication hole portions 321, 322, 323 and 324, and also improve rigidity of the pressure plate 2*c* by connections between the communication hole portions 321, 322, 323 and 324.

The first communication hole portion 321 is disposed between the first straightening vane 33 and the second straightening vane 34 in the circumferential direction. This prevents the hydraulic fluid which has entered the discharge pressure chamber 202 through the first communication hole-portion 321 and the hydraulic fluid which has entered the discharge pressure chamber 202 through the other communication hole portions 322, 323 and 324 from joining together at the second contracted portion 64. It is then possible to prevent the effect of the first communication hole portion 321 from being exerted against a contraction effect of the second contracted portion 64.

The third straightening vane 35 does not face the communication hole portions 321, 322, 323 and 324 in the z-axis direction. The interflow of the hydraulic fluid therefore does not occur at the third contracted portion 65, which reduces the fluctuation in the pressure of the hydraulic fluid passing through the third contracted portion 65. Consequently, a sufficient straightening effect can be exerted by the third contracted portion 65, which further reduces the fluctuation in the pressure on the upstream side of the metering orifice 16.

The first contracted portion 63 and the third contracted portion 65 are smaller in z-axial length than the second contracted portion 64. Since the first contracted portion 63 is designed to be smaller in opening area than the second contracted portion 64, it is possible to improve the straightening effect of the first contracted portion 63 which has the largest influence on the pressure on the upstream side of the metering orifice 16 among the contracted portions 63, 64 and 65. Since the third straightening vane 35 is designed to be larger in height (z-axial length) than the second straightening vane 34, it is possible to improve rigidity of the discharge pressure chamber 202 which is a relatively large space.

The first contracted portion 63 is equal in z-axial length to the third contracted portion 65. Since the first contracted portion 63 has one of the smallest flow channel sectional areas among the contracted portions 63, 64 and 65, it is possible to improve the straightening effect exerted by the first contracted portion 63.

The discharge pressure chamber 202 is disposed between the first straightening vane 33 and the one end-side opening 16*a* of the metering orifice 16. The discharge pressure chamber 202 includes the first chamber section 36 whose flow channel sectional area is larger than the sectional area of the first contracted portion 63 and the sectional area of the one end-side opening 16*a*. Since the first chamber section 36 reduces the pressure pulsation of the hydraulic fluid immediately before the hydraulic fluid is introduced to the metering orifice 16, it is possible to further reduce the fluctuation in pressure on the upstream side of the metering orifice 16.

The one end-side opening 14*a* of the discharge passage 14 is offset from the first contracted portion 63 in the z-axis direction. This improves the pulsation-reducing effect of the first chamber section 36 as compared to a case in which the first contracted portion 63 and the one end-side opening 14*a* of the discharge passage 14 face each other.

The one circumferential end-side inner peripheral surface 60 of the front body 2*a* defines the first chamber section 36. The predetermined region which is part of the one circumferential end-side inner peripheral surface 60 and includes the one end-side opening 16*a* is provided with the machined surface 60*a* grinded by machining. The one end-side opening 16*a* is machined with high accuracy, which improves dimensional accuracy of the metering orifice 16. It is therefore possible to improve control accuracy of the control valve 4.

OTHER EMBODIMENTS

The invention has been described on the basis of the Embodiment. However, the specific configuration of the invention is not limited to the configuration discussed in the Embodiment. Design modification and the like which do not deviate from the gist of the invention are included in the invention.

For example, the variable displacement vane pump of the invention is applicable to other hydraulic devices than power steering systems.

The first straightening vane 33 may be designed larger in length than the third straightening vane 35.

The second straightening vane 34 may be disposed so as not to face the communication hole 32 in the z-axis direction. This makes the hydraulic fluid in the second contracted portion 64 form a single flow. It is thus possible to obtain a sufficient straightening effect at the second straightening vane 34 and further reduce the fluctuation in the pressure on the upstream side of the metering orifice 16.

The following description will explain a technical idea which can be understood from the above-discussed embodiment.

A variable displacement vane pump according to one aspect comprises a pump housing including a first housing having a cylindrical portion and a bottom provided at one end side of a cylindrical portion and a second housing provided at the other end side of the cylindrical portion to close the other end side of the cylindrical portion; a drive shaft rotatably provided in the pump housing; a rotor rotated by the drive shaft and having slits; vanes projectably or retractably provided in the slits of the rotor; a cam ring disposed within the cylindrical portion, provided to be movable relative to a rotational axis of the drive shaft, formed into a cylindrical shape, and forming a plurality of pumping chambers together with the rotor and the vanes; an inlet port provided to the pump housing and formed to open into a suction area which is part of the plurality of pumping chambers, the suction area in which volumes of the pumping chambers increase with the rotation of the rotor; a high pressure chamber provided in the first housing, the high pressure chamber and the inlet portion being located on the opposite sides relative to the drive shaft, and being formed into a substantially arc-like shape so as to open into a discharge area which is part of the plurality of pumping chambers, the discharge area in which the volumes of the pumping chambers decrease as the rotor rotates; a discharge passage created in the first housing and configured to discharge hydraulic fluid to the outside of the pump housing, the discharge passage including one end-side opening which opens into the high pressure chamber; a pressure plate disposed between the rotor and the high pressure chamber in a direction of the rotational axis of the drive shaft, the pressure plate being provided with a communication hole which connects the pumping chamber and the high pressure chamber to each other and being biased toward the rotor by pressure of the hydraulic fluid in the high pressure chamber; an orifice provided in the discharge passage; a control mechanism provided in the pump housing, controlled according to differential pressure between upstream and downstream sides of the orifice, and configured to control displacement of the cam ring; and a plurality of ribs provided within the high pressure chamber and formed so as to connect a pair of regions which is part of the inner peripheral surface of the high pressure chamber, the regions being arranged opposite to each other in a radial direction of the rotational axis of the drive shaft, the plurality of ribs including a first rib located on a closest side to the one end-side opening of the discharge passage in a direction around the rotational axis of the drive shaft (a direction indicated by the double-headed arrow in FIG. 6) and provided so as not to face the communication hole in a direction of the rotational axis of the drive shaft, and a second rib, the second rib and the first rib being located on the opposite sides relative to the one end-side opening of the discharge passage.

In a preferable aspect of the invention according to the above aspect, the communication hole of the pressure plate includes a first communication hole portion formed on a closest side to the one end-side opening of the discharge passage in the direction around the rotational axis of the drive shaft, and a second communication hole portion, the second communication hole portion and the first communication hole portion located on the opposite sides relative to the one end-side opening of the discharge passage.

In another preferable aspect of the invention according to any one of the above aspects, the first communication hole portion is located more opposite to the one end-side opening of the discharge passage than the first rib in the direction around the rotational axis of the drive shaft.

In still another preferable aspect of the invention according to any one of the above aspects, the first communication hole portion is located between the first and second ribs in the direction around the rotational axis of the drive shaft.

In still another preferable aspect of the invention according to any one of the above aspects, the second rib is located so as not to face the communication hole in a direction of the rotational axis of the drive shaft.

In still another preferable aspect of the invention according to any one of the above aspects, there is provided a third rib provided within the high pressure chamber, the third rib and the second rib are located on the opposite sides relative to the first rib in the direction around the rotational axis of the drive shaft, the third rib being located so as not to face the communication hole in the direction of the rotational axis of the drive shaft.

In still another preferable aspect of the invention according to any one of the above aspects, there is provided a third rib disposed in the high pressure chamber, and the third rib and the second rib are located on the opposite sides relative to the first rib in the direction around the rotational axis of the drive shaft, the first and third ribs being located so that a gap between each of the first and third ribs and the pressure plate in the direction of the rotational axis of the drive shaft is smaller than the gap between the second rib and the pressure plate.

In still another preferable aspect of the invention according to any one of the above aspects, the first rib is formed so that the gap between the first rib and the pressure plate in the direction of the rotational axis of the drive shaft is equal to or smaller than the gap between the third rib and the pressure plate.

In still another preferable aspect of the invention according to any one of the above aspects, the high pressure chamber includes a chamber section provided between the first rib and the one end-side opening of the discharge passage and having flow channel sectional area which is larger than sectional area of the gap between the first rib and the pressure plate and sectional area of the one end-side opening of the discharge passage.

In still another preferable aspect of the invention according to any one of the above aspects, the one end-side opening of the discharge passage is offset from the gap between the first rib and the pressure plate in the direction of the rotational axis of the drive shaft.

In still another preferable aspect of the invention according to any one of the above aspects, the orifice is provided adjacent to the one end-side opening of the discharge passage; and the chamber section includes a machined surface located in a region which is part of an inner peripheral surface of the chamber section and is provided with the one end-side opening of the discharge passage, the machined surface being grinded by machining.

The above description has discussed only some embodiments of the invention. One skilled in the art should easily understand that the exemplary embodiments may be modified or improved in various ways without materially departing from the novel teachings and advantages of the invention. Accordingly, all such modifications and improvement are intended to be included within the technical scope of the invention. The embodiments may be combined in any ways.

The present application claims priority under Japanese Patent Application No. 2016-043541 filed on Mar. 7, 2016. The entire disclosure of Japanese Patent Application No. 2016-043541 filed on Mar. 7, 2016, including the description, claims, drawings and abstract, is incorporated herein by reference in its entirety.

REFERENCE SIGNS LIST

0 Rotational axis
1 Variable displacement vane pump
2 Pump housing
**2*a*** Front body (first housing)
**2*b*** Rear body (second housing)
**2*c*** Pressure plate
4 Control valve (Control mechanism)
6 Drive shaft
8 Rotor
9 Cam ring
14 Discharge passage
**14*a*** One end-side opening
16 Metering orifice
**20*a*** Bottom
22 Inlet port
32 Communication hole
36 First chamber section
37 Second chamber section
38 Third chamber section
39 Fourth chamber section
60 One circumferential end-side inner peripheral surface
**60*a*** Machined surface
63 First contracted portion (First rib)
64 Second contracted portion (Second rib)
65 Third contracted portion (Third rib)
81 Vane

82 Pumping chamber
202 Discharge pressure chamber (High pressure chamber)
211 Cylindrical portion
321 First communication hole portion
322 Second communication hole section
323 Third communication hole section
324 Fourth communication hole section

The invention claimed is:

1. A variable displacement vane pump comprising:

a pump housing including a first housing having a cylindrical portion and a bottom located on one end side of the cylindrical portion, and a second housing located on an opposite end side of the cylindrical portion to close the opposite end side of the cylindrical portion;

a drive shaft rotatably provided in the pump housing;

a rotor rotated by the drive shaft and provided with slits;

vanes projectably or retractably provided in the slits of the rotor;

a cam ring disposed within the cylindrical portion, provided to be movable relative to a rotational axis of the drive shaft, formed into a cylindrical shape, and forming a plurality of pumping chambers together with the rotor and the vanes, the cam ring being provided with a suction area in which volumes of the pumping chambers increase as the rotor rotates and a discharge area in which volumes of the pumping chambers decrease as the rotor rotates;

an inlet port formed in the pump housing so as to open into the suction area;

a high pressure chamber provided in the first housing, the high pressure chamber being located opposite to the inlet port relative to the drive shaft, and the high pressure chamber being formed into a substantially annular shape so as to open into the discharge area;

a discharge passage disposed in the first housing and configured to discharge hydraulic fluid to the outside of the pump housing, the discharge passage being formed so that one end-side opening of the discharge passage opens into the high pressure chamber;

a pressure plate disposed between the rotor and the high pressure chamber in a direction of the rotational axis of the drive shaft, the pressure plate being provided with a communication hole which connects the pumping chambers and the high pressure chamber to each other and being biased toward the rotor by pressure of the hydraulic fluid in the high pressure chamber;

an orifice provided in the discharge passage;

a control valve which is provided in the pump housing and controllable according to differential pressure between upstream and downstream sides of the orifice, and configured to control displacement of the cam ring; and a plurality of ribs provided within the high pressure chamber and formed so as to connect parts of an inner peripheral surface and an outer peripheral surface of the high pressure chamber, the parts being arranged opposite to each other in a radial direction of the rotational axis of the drive shaft, the plurality of ribs including:

a first rib located on a closest side to the one end-side opening of the discharge passage in a direction around the rotational axis of the drive shaft, a top portion of the first rib being provided so as not to face the communication hole in a direction of the rotational axis of the drive shaft, and a second rib, the second rib being located at a position adjacent the first rib in a direction away from the one end-side opening of the discharge passage, wherein the communication hole of the pressure plate includes a first communication hole portion formed on a closest side to the one end-side opening of the discharge passage in the direction around the rotational axis of the drive shaft, and a second communication hole portion, the second communication hole portion being located at a position adjacent the first communication hole portion in the direction away from the one end-side opening of the discharge passage.

2. The variable displacement vane pump described in claim 1, wherein the first communication hole portion is located farther from the one end-side opening of the discharge passage than the first rib in the direction around the rotational axis of the drive shaft.

3. The variable displacement vane pump described in claim 2, wherein the first communication hole portion is located between the first and second ribs in the direction around the rotational axis of the drive shaft.

4. The variable displacement vane pump described in claim 1, wherein the second rib is located so as not to face the communication hole in a direction of the rotational axis of the drive shaft.

5. The variable displacement vane pump described in claim 4, comprising:

a third rib provided within the high pressure chamber, the third rib and the first rib being located on the opposite sides relative to the second rib in the direction around the rotational axis of the drive shaft, wherein the third rib is located so as not to face the communication hole in the direction around the rotational axis of the drive shaft.

6. The variable displacement vane pump described in claim 1, comprising:

a third rib disposed in the high pressure chamber, the third rib and the first rib being located on the opposite sides relative to the second rib in the direction around the rotational axis of the drive shaft, wherein the first and third ribs are arranged so that a gap between the first rib and the pressure plate in the direction around the rotational axis of the drive shaft and a gap between the third rib and the pressure plate in the direction around the rotational axis of the drive shaft is smaller than a gap between the second rib and the pressure plate.

7. The variable displacement vane pump described in claim 6, wherein the first rib is formed so that the gap between the pressure plate and the first rib in the direction of the rotational axis of the drive shaft is equal to or smaller than the gap between the pressure plate and the third rib.

8. The variable displacement vane pump described in claim 1, wherein the high pressure chamber includes a chamber section;

the chamber section is provided between the first rib and the one end-side opening of the discharge passage; and a flow channel sectional area of the chamber section is larger than a sectional area of a gap between the first rib and the pressure plate and larger than a sectional area of the one end-side opening of the discharge passage.

9. The variable displacement vane pump described in claim 8, wherein the one end-side opening of the discharge passage is offset from the gap between the first rib and the pressure plate in the direction of the rotational axis of the drive shaft.

10. The variable displacement vane pump described in claim 8, wherein the orifice is provided adjacent to the one end-side opening of the discharge passage;

the chamber section includes a machined surface grinded by machining; and the machined surface is located in a region which is part of an inner peripheral surface of the chamber section, the region being provided with the one end-side opening of the discharge passage.

* * * * *